US006950061B2

(12) United States Patent
Howell et al.

(10) Patent No.: US 6,950,061 B2
(45) Date of Patent: Sep. 27, 2005

(54) ANTENNA ARRAY FOR MOVING VEHICLES

(75) Inventors: James M. Howell, Woodstock, GA (US); Robert A. Freeman, Norcross, GA (US)

(73) Assignee: EMS Technologies, Inc., Norcross, GA (US)

( * ) Notice: Subject to any disclaimer, the term of this patent is extended or adjusted under 35 U.S.C. 154(b) by 3 days.

(21) Appl. No.: 10/291,443

(22) Filed: Nov. 8, 2002

(65) Prior Publication Data

US 2003/0090416 A1 May 15, 2003

Related U.S. Application Data

(60) Provisional application No. 60/345,065, filed on Nov. 9, 2001.

(51) Int. Cl.[7] ..... H01Q 3/00
(52) U.S. Cl. ..... 342/359; 343/757
(58) Field of Search ..... 342/359; 343/711, 343/754, 757

(56) References Cited

U.S. PATENT DOCUMENTS

| | | | | |
|---|---|---|---|---|
| 5,517,205 A | | 5/1996 | Van Heyningen et al. | |
| 5,781,163 A | | 7/1998 | Ricardi et al. | |
| 5,805,115 A | | 9/1998 | Pellerin et al. | |
| 5,835,057 A | | 11/1998 | Van Heyningen | |
| 5,929,819 A | | 7/1999 | Grinberg | |
| 5,982,333 A | * | 11/1999 | Stillinger et al. | 343/766 |
| 6,034,634 A | * | 3/2000 | Karlsson et al. | 342/359 |
| 6,049,306 A | * | 4/2000 | Amarillas | 342/359 |
| 6,124,832 A | | 9/2000 | Jeon et al. | |
| 6,191,734 B1 | | 2/2001 | Park et al. | |
| 6,243,052 B1 | | 6/2001 | Goldstein et al. | |
| 6,396,448 B1 | * | 5/2002 | Zimmerman et al. | 343/753 |
| 6,407,714 B1 | | 6/2002 | Butler et al. | |
| 6,552,695 B1 | | 4/2003 | Strickland | |
| 2002/0089462 A1 | | 7/2002 | Monzon | |
| 2002/0167449 A1 | | 11/2002 | Frazita et al. | |
| 2003/0080898 A1 | * | 5/2003 | Wang et al. | 342/359 |
| 2003/0080907 A1 | | 5/2003 | Wang et al. | |
| 2003/0083063 A1 | | 5/2003 | Wang et al. | |

FOREIGN PATENT DOCUMENTS

| | | |
|---|---|---|
| WO | WO 01/15275 | 3/2001 |

OTHER PUBLICATIONS

Skolnik, Merill I., 7/10 Stabilization of Antennas, Introduction to Radar Systems, p. 270–274, Second Edition, McGraw–Hill Internation Book Company.

* cited by examiner

*Primary Examiner*—Gregory C. Issing
(74) *Attorney, Agent, or Firm*—Troutman Sanders LLP

(57) ABSTRACT

A low-profile antenna system to be mounted to a moving vehicle for receiving signals, such as from a Digital Broadcast Satellite, includes a base for mounting to the surface of the vehicle, a platen mounted to the base for rotation, an azimuth drive motor for rotating the platen, an array of half-cylinder antenna elements mounted to the platen, an elevation drive motor for pivoting the antenna elements individually about their axes to change the elevation at which the antenna elements are pointing, and a cover. The azimuth drive motor and the elevation drive motor together allow the array of antenna elements to be pointed at a satellite over a wide range of vehicle orientations.

39 Claims, 5 Drawing Sheets

ANTENNA ARRAY FOR MOVING VEHICLES

CROSS-REFERENCE TO RELATED APPLICATIONS

The present application claims the priority benefit of U.S. provisional patent application Ser. No. 60/345,065, filed on Nov. 9, 2001 and incorporates the same herein by reference.

TECHNICAL FIELD

The present invention is directed generally to antennas and particularly to antenna systems for mounting to a vehicle for receiving signals, such as from a Direct Broadcast Satellite (DBS).

BACKGROUND OF THE INVENTION

With the proliferation of various communication and entertainment technologies, it is becoming increasingly desirable to receive signals in moving vehicles. Today's vehicles sometimes receive radio, wireless telephone signals, email, electronic data, Global Positioning Satellite (GPS) data, television signals, etc. This need for in-vehicle reception exists in consumer automobiles, commercial automobiles and trucks, commercial and private airplanes, pleasure and commercial boats, and in military vehicles of all sorts, just to name a few. For many of these applications, it would be desirable if the signals could be received using a rather unobtrusive antenna. At the same time, it can be desirable to use a large, somewhat narrow beam antenna, as opposed to a small, wide beam antenna, in order to be able to pick up signals from rather remote sources (which can be faint).

Moreover, in order to collect the faint signals from the remote sources, often it is necessary to keep the antenna pointed at the source. Unfortunately, the movement of a vehicle makes it difficult for a typical antenna to track a signal source. The antenna could be made to track side-to-side (azimuth) and up and down (elevation), but if the antenna is of substantial size, this has disadvantages. One such serious disadvantage is that the antenna might then protrude significantly at times, interfering with the smooth airflow over the vehicle or adversely affecting the aesthetics of the vehicle.

In military radar applications for aircraft, it has been known to utilize an array of antenna elements and to mechanically rotate the array in azimuth to provide wide side-to-side coverage. To provide wide up and down (elevation) coverage, the radar array is electronically controlled to "look" in a wide variety of elevation directions (to scan in elevation without moving the antenna elements physically). The electronic control consists of applying phase shifts to the incoming electromagnetic energy received at the various antenna elements to cause the energy received from a desired direction to add up constructively, allowing the array to "see" in that direction. Unfortunately, the electronic hardware typically needed for such scanning by applying varying phase shifts is rather expensive, limiting the practical application of such antenna arrays to military or similar applications.

In recent years, Earth-orbit satellites have been launched to provide digital television signals directly to peoples' homes. These satellites are called Direct Broadcast Satellites (DBS). Typically, the satellite is placed into a geosynchronous (stationary) orbit around the Earth. As such, in order to receive the television signals at a building or home, a small antenna dish typically is mounted to the building or to a nearby mounting pole and is aimed at the satellite. These small antenna dishes are concave and are about the size of a pizza pan.

While such dish antenna designs are useful for receiving the DBS signal at a building, these antennas are especially ill-suited for use on a moving vehicle. This is so because this type of dish antenna presents a rather large profile, which can interrupt smooth airflow as the vehicle travels. Indeed, the dish antenna is large enough and has a large enough profile that wind resistance and noise generated thereby would be very objectionable if one were to mount the dish antenna to the outside of the vehicle. Moreover, because of the large profile of the dish antenna, mounting this antenna securely enough to maintain a stable position despite wind resistance presents a formidable challenge.

As mentioned above, mounting a dish antenna to a vehicle presents an additional challenge in the difficulty of keeping the antenna trained on the satellite. The reason for the difficulty is that the vehicle changes orientation in use. One moment the vehicle is oriented in one direction and at another moment the vehicle can be turned to be pointing in a very different direction. For example, in order for a vehicle-mounted DBS antenna to be useful, it would need to be able to be trained on the satellite and generally stay pointed at the satellite regardless of changes in orientation of the vehicle. To accomplish this with a dish antenna would mean rotating the dish and/or changing the elevation angle of the dish. In general, this is impractical.

Accordingly, it can be seen that a need remains in the art for a low-cost directional antenna which can be mounted to a vehicle for receiving signals, which antenna has a low profile, and which can be trained on a source and continue to point at the source as the vehicle changes orientation. It is to the provision of such an antenna that present invention is primarily directed.

SUMMARY OF THE INVENTION

Briefly described, in a first preferred form the present invention comprises a low-profile antenna for mounting to a vehicle. The low-profile antenna includes an array of antenna elements for receiving incoming electromagnetic signals. An azimuth drive is provided for physically rotating the array of antenna elements about an azimuth axis. Furthermore, an altitude drive is provided for physically pivoting the individual antenna elements to change the elevation angle at which the individual antenna elements point. With this construction, the antenna system can be pointed at a source, such as a satellite, by operation of the azimuth drive and/or the altitude drive and can maintain the pointing over a wide range of vehicle orientations.

Preferably, the antenna elements are each a low-profile element. More preferably, the antenna elements are half-cylinders each comprising a dielectric cylinder with a reflector extending axially therein. In one optional form, the antenna elements are all about the same size and lie in one plane. In another optional form, the antenna elements are of different sizes. Preferably, the antenna elements lie in a plane which is generally perpendicular to the azimuth axis. Optionally, the antenna elements can lie generally in a plane which is at an acute angle with respect to the azimuth axis. Optionally, the antenna elements can be positioned in one orientation relative to the azimuth axis for pointing at a satellite roughly overhead and the orientation of the elements can be varied relative to the azimuth axis by tilting the entire grouping.

Preferably, the antenna elements are controlled in elevation together using a single drive motor to effect elevation changes. Also preferably, the antenna system includes phase shifters to phase align the antenna elements. In one form, the phase shifters comprise mechanical "trombone" phase shifters. In another form, the phase shifters comprise electronic ferrite phase shifters.

Preferably, the antenna further includes a controller for monitoring signals received by the antenna array and for controlling the elevation drive and the azimuth drive to maximize the signal so received. Moreover, ideally the controller also is operative for controlling the operation of the mechanical phase shifters.

Preferably, the antenna elements are mounted to a sub-base or platen and the sub-base has a major dimension of about 30 inches or less. Also preferably, the antenna array system has a low profile such that wind resistance and wind noise are minimized. Typically, the antenna system is much wider than it is tall. Preferably, the number of antenna elements is between 2 and 12. More preferably, there are between 4 and 8 antenna elements in the array.

It is preferred that the antenna system includes feed sources in the form of slotted waveguides associated with each antenna element. The slotted waveguides can be positioned below each associated antenna element. Alternatively, the slotted waveguides can be positioned laterally to the side of the associated antenna element.

Preferably, the outputs from the feed sources are combined and then channeled through a single channel rotary joint for coupling the combined signal with an external device. For example, the combined signal can be coupled to a DBS tuner for connection to a television screen.

Advantageously, by utilizing an array of relatively small elements, the overall profile of the system can be kept low. At the same time, the individual elements are controlled to maintain good pointing at the source. Collectively, the output from the array of elements is adequate to deliver a good, usable signal even from a relatively weak input signal, such as from a direct broadcast satellite. The invention therefore provides a low profile antenna system which is effective for receiving a variety of signals and is well-suited for use with moving vehicles. The low profile nature of the antenna system makes it practical to use the system on a wide variety of vehicles. Such vehicles would include automobiles, vans, trucks, buses, trains, boats, airplanes, tractors, off-road vehicles, etc.

One exemplary application for the invention is the use of the antenna on moving vehicles to receive DBS television and audio signals from a geosynchronous (fixed orbit) satellite. In such an application, it should be noted that a single satellite typically broadcasts its signal over a very wide area, such as North America, with the result being that the signal to be picked up at the vehicle is rather weak. This would ordinarily indicate the use of a somewhat large antenna. The present invention allows the rather weak signal to be picked up using the array of elements and combined into a signal of sufficient strength to be useful. The present invention also allows the antenna to be trained on and track the satellite, despite movement of the vehicle in various orientations. Also, the invention accomplishes this while maintaining a rather low, unobtrusive profile that does not interfere excessively with the airflow past the vehicle as the vehicle moves.

Other features and advantages of the present invention will become more apparent upon reading the following specification in conjunction with the accompanying drawing figures.

BRIEF DESCRIPTION OF THE DRAWING FIGURES

DETAILED DESCRIPTION OF THE PREFERRED EMBODIMENTS

Figure 1:
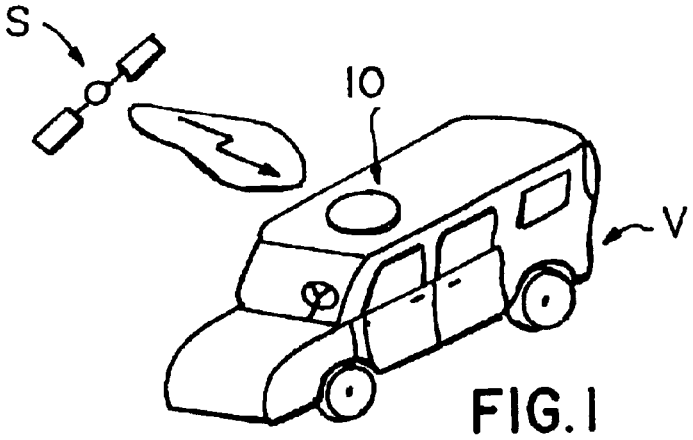
FIG. 1 is a schematic illustration of an antenna array according to a preferred form of the invention and shows the antenna array mounted to a van for receiving signals while the van moves, such as from a DBS satellite.

Referring now in detail to the drawing figures, in which like reference numerals refer to like parts throughout the several views, FIG. 1 is a schematic illustration of an antenna system 10 according to a preferred form of the invention and shows the antenna system 10 mounted to a van V for receiving signals while the van moves, such as from a DBS satellite S. The antenna system 10 has a rather low profile, making it especially useful for mounting to the surface of a vehicle. In particular, the height of the system is much smaller than its transverse dimension (diameter, if the antenna system is round). For example, it is contemplated that if implemented as a receive antenna for receiving DBS signals, the antenna system typically would have a round overall shape, with a diameter of about 24 to 36 inches and would have a height of only about 2 to 4 inches. Of course, those skilled in the art will recognize that while the exemplary embodiments of the invention shown in the figures are shown in connection with a van, other types of vehicles can take advantage of the present invention. For example, the invention is useful with automobiles, vans, trucks, buses, trains, boats, airplanes, tractors, off-road vehicles, military vehicles, and a wide variety of other moving vehicles.

Figure 2:
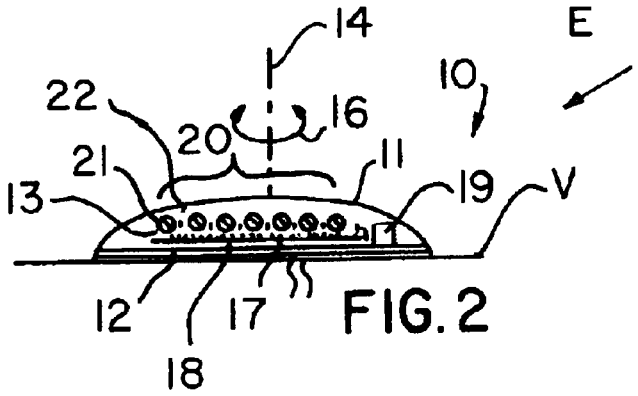
FIG. 2 is a schematic, side sectional illustration of the antenna array of FIG. 1.

FIG. 2 is a schematic, side sectional illustration of the antenna array 10 of FIG. 1. As shown in FIG. 2, the antenna array system 10 includes a dielectric cover or fairing 11 and a base 12 for mounting to the surface of the vehicle V. The antenna array system 10 further includes a sub-base (turntable or platen) 13 rotatably mounted to the base 12 for rotation about an azimuth axis 14. In this regard, the platen 13 can rotate back and forth in the direction of direction arrow 16. The platen 13 is rotatably mounted to the base 12 using an axle 17. The platen 13 can be provided with a ring gear 18 around the periphery thereof to engage with an unshown gear driven by azimuth drive motor 19. In this way, the azimuth drive motor 19 can rotate the platen 13 in the direction of direction arrow 16 about the azimuth axis 14.

FIG. 2 also shows a number of half-cylinder antenna elements indicated generally at 20 and forming a planar array of antenna elements for receiving electromagnetic energy E from a remote source, such as DBS satellite S. Each individual antenna element, such as antenna element 21, has a feed source associated therewith, such as feed source 22. Preferably, the feed sources comprise slotted waveguides which are positioned laterally to the side of the associated antenna elements. Those skilled in the art will recognize that other types of feed sources can be employed, as desired.

Figure 3:
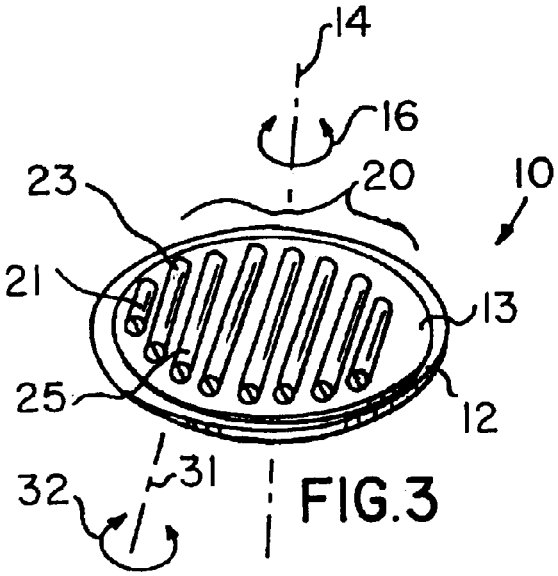
FIG. 3 is a schematic, perspective illustration of the antenna array of FIG. 1, shown with a cover portion thereof removed and other parts omitted for clarity of illustration.

Referring now to FIG. 3, the array of antenna elements 20 is better seen to comprise an array of elongate, half-cylinder antenna elements which are spaced apart from one another and oriented generally parallel to one another. The spacing of the antenna elements from one to the next preferably is selected to allow the antenna elements to receive incoming electromagnetic energy E at relatively low receive angles without vignetting one another. When considering the antenna system 10 shown in this figure, it should be understood that FIG. 3 is a schematic, perspective illustration of the antenna array of FIG. 1, shown with the cover 11 removed, and other parts omitted for clarity of illustration. As shown in the figure, the antenna elements are spaced apart about a little more than one antenna diameter. The actual spacing of the elements can be varied depending on the intended application. If the system is to be used for DBS reception, it might be desirable to employ it in different configurations depending on the latitude at which the system is to be used. As mentioned above, a DBS satellite is stationary, geosynchronous and generally positioned above the Earth's equator. If the system is to be used on a vehicle which will remain close to the equator (for example, within or near the tropics), the spacing of the antenna elements can be quite small or dispensed with and the antenna array can be made to be smaller. This is so because the satellite is more nearly overhead. Conversely, if the system is to be used on a vehicle which will remain far from the equator, the relatively low angle at which the antenna must look at the satellite may make it desirable to space the antenna elements farther apart to avoid vignetting and to make the array larger.

As shown in FIG. 3, the individual antenna elements, such as antenna element 25 are each mounted for pivotal movement relative to the platen 13. For example, antenna element 25 is mounted for pivotal motion about its axis of elongation 31 in the direction of direction arrow 32. Likewise, each of the antenna elements in the array 20 is similarly mounted for pivotal movement relative to the platen 13. Preferably, the individual antenna elements are moved together, in a coordinated fashion, so that they can point together in the same direction. Preferably, this is accomplished using a single elevation motor acting through a gang mechanism, as will be described in connection with FIG. 6.

Figure 4:
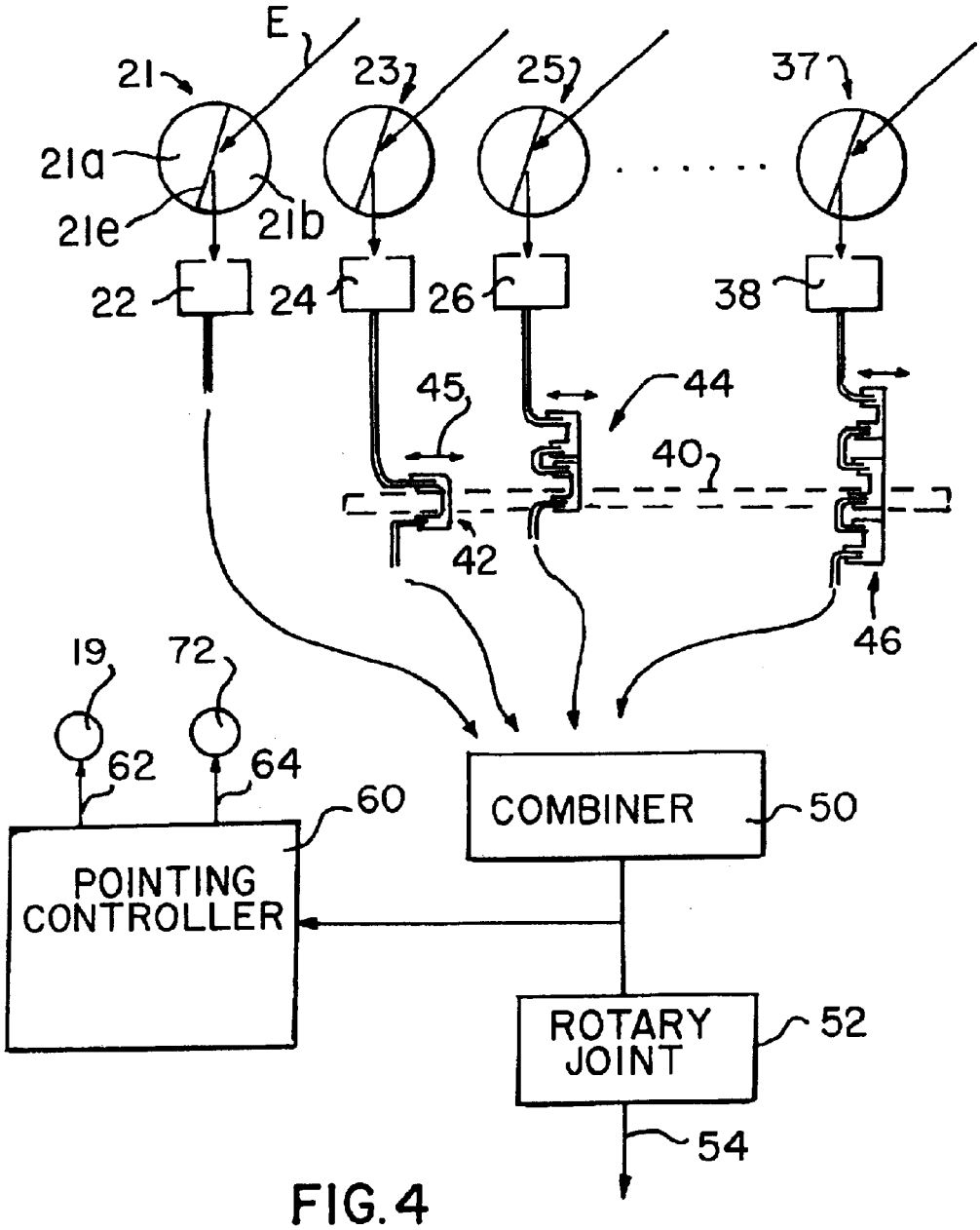
FIG. 4 is a schematic, functional illustration of the antenna array of FIG. 1, showing the path that incoming energy takes as it is collected by the elements of the array and combined for subsequent output.

Turning now to FIG. 4, this figure is a schematic, functional illustration of the antenna array of FIG. 1, showing the path that incoming energy E takes as it is collected by the elements of the array 20 and combined for subsequent output. As shown in this figure, each of the antenna elements, such as antenna elements 21, 23, 25, . . . 37, receives incoming energy E. The individual antenna elements each include a dielectric half of a cylinder, such as 21*a* and a second dielectric half of a cylinder, such as 21*b*. A reflector consisting of a metallicized layer or metallic layer 21*c* separates the two half-cylinders 21*a* and 21*b*. This construction is typical for each of the antenna elements 21, 23, 25, . . . 37. Each of the antenna elements further has a feed source associated therewith, such as feed source 22. As shown in this figure, the feed source 22 preferably comprises a slotted waveguide. As shown schematically in this figure, the slotted waveguide can be positioned beneath the antenna element. Moreover, as shown in FIG. 2, the slotted waveguide can be positioned laterally to the side of the antenna element. The other antenna elements have their own slotted waveguides, such as slotted waveguides 24, 26, and 38.

The output from the last of the slotted waveguides 22 is directed or coupled directly to the combiner. The output from the other slotted waveguides is directed or coupled to a mechanical phase shifter, such as phase shifters 42, 44, 46. It should be noted that each of the antenna elements after the first (after antenna element 37) requires greater and greater modification of path length. This is accomplished by extension and contraction of the "trombone" type mechanical phase shifters, which allows the optical path length for individual antenna elements to be adjusted. In this way, the electromagnetic energy delivered to the combiner 50 from the various antenna elements can all be received in phase so that a strong resulting signal is obtained. Those skilled in the art will recognize that the phase shifters are controlled in a manner to progressively lengthen the optical path length, beginning with the farthest antenna element (relative to the source). For example, in the particular configuration orientation situation shown in FIG. 4, the electromagnetic energy received by antenna element 38 would need to be phase delayed (it's optical path length would need to be lengthened) in relation to the energy received at antenna element 25. Likewise, the energy received at antenna element 25 would need to be phase delayed even more than that received at antenna element 23, and so on. To accomplish this, the sliding "trombones" are extended or retracted as required in the direction of direction arrow 45. Moreover, as shown in this figure, the individual trombones can be ganged. For example, phase shifter 44 comprises two trombone sections operating in tandem to double the extension of the path length in comparison to the single unit 42. Likewise, the triple unit 46 obtains three times as much path length extension as that of single unit 42. One advantage that flows from this arrangement is that a single actuator can be employed to change the path lengths of all of the antenna elements.

It should be noted that the amount of phase shift required at each of the individual antenna elements varies with the orientation of the antenna elements. For example, when antenna elements are oriented to receive electromagnetic energy from directly overhead, little or no phase shift is required. Likewise, when the antenna elements are oriented to receive electromagnetic energy from a low angle, a more substantial phase shift is required from one antenna element to the next. The amount of the phase shift required varies with the angle of the incoming electromagnetic energy. Therefore, the actuator mechanism that is used to control the phase shifters can be driven by the same motor used to control the angular orientation of the individual antenna elements. Advantageously, this minimizes expense. For example, the phase shifters 42, 44, 46 can be all moved back and forth by a linkage arm, such as linkage arm 40 shown in dashed lines in this figure.

Still referring to FIG. 4, the combiner 50 collects the phase aligned signals from the various antenna elements and combines them. The combined signal is then outputted to a rotary joint 52 through which an output signal 54 is produced which can be used by a subsequent device. The rotary joint 52 allows reliable communication of the output signal despite the back and forth rotation of the platen 13. The output signal 54 is used by a subsequent device, such as a DBS television tuner or other device.

A pointing controller 60 is provided for controlling operation of the platen 13, the antenna elements 20, and the phase shifters. The pointing controller 60 samples the signal delivered from the combiner 50. The controller 60 then controls the azimuth pointing of the platen 13, the elevation pointing of the antenna elements 20, and the phase delays effected by the phase shifters to obtain and maintain a signal of maximum strength. To accomplish this, the pointing controller 60 sends a control signal 62 to the azimuth drive motor 19 to effect the desired azimuth pointing of the platen 13. Likewise, the pointing controller 60 sends another control signal 64 to control operation of the elevation drive motor 72 to point the individual antenna elements in a desired elevation direction. The controller 60 can be used to separately control the phase shifters or the control of the phase shifters can be subsumed in the control of the elevation drive (the phase shifters can be mechanically linked to the elevation drive motor 72).

Figure 5:
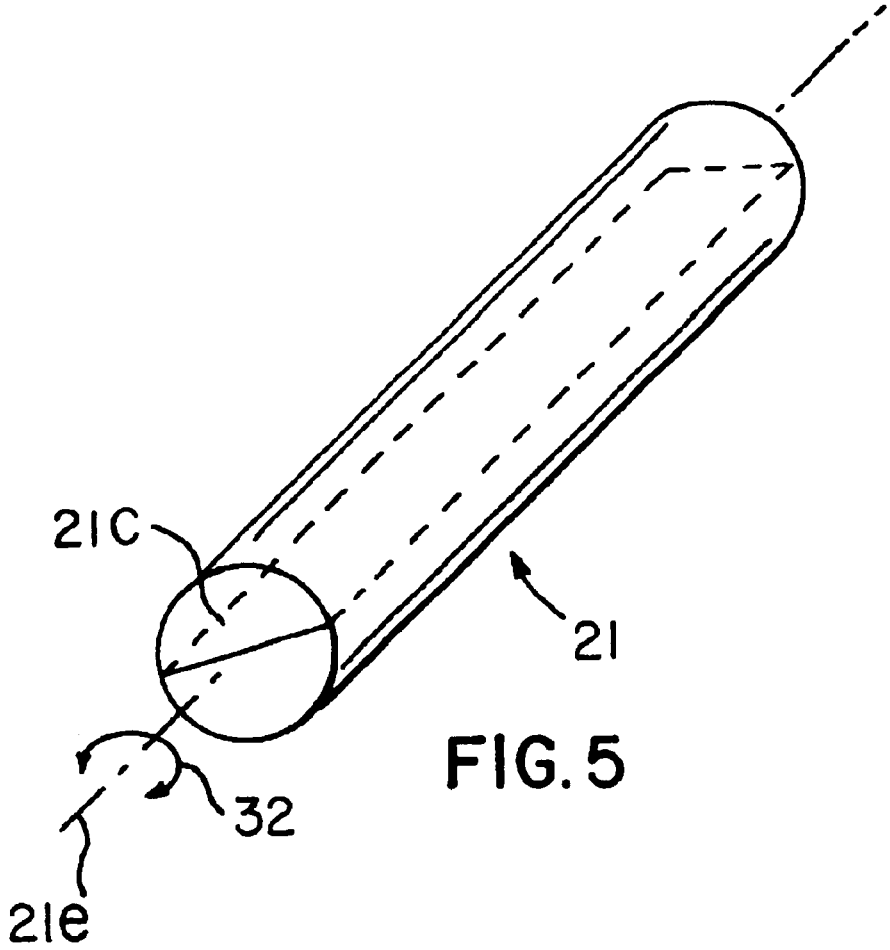
FIG. 5 is a perspective illustration of a half-cylinder antenna element portion of the antenna array of FIG. 1.

Referring now to FIG. 5, this figure is a perspective illustration of a half-cylinder antenna element portion of the antenna array of FIG. 1. In particular, a typical antenna element is shown, such as antenna element 21. Antenna element 21 is elongated and cylindrical and has an axis of elongation 21*e*. Antenna element 21 is rotated back and forth in the direction of direction arrow 32 about the axis of elongation 21*e*. Antenna element 21 is made of a dielectric material which acts as a lens to focus incoming electromagnetic energy. Embedded in the middle of the antenna element 21 is a reflector 21*c*, which extends axially therein along the length of the antenna element. The reflector 21*c* receives the focused energy from the lens and reflects it to the feed source (in this case, a slotted waveguide).

Figure 6:
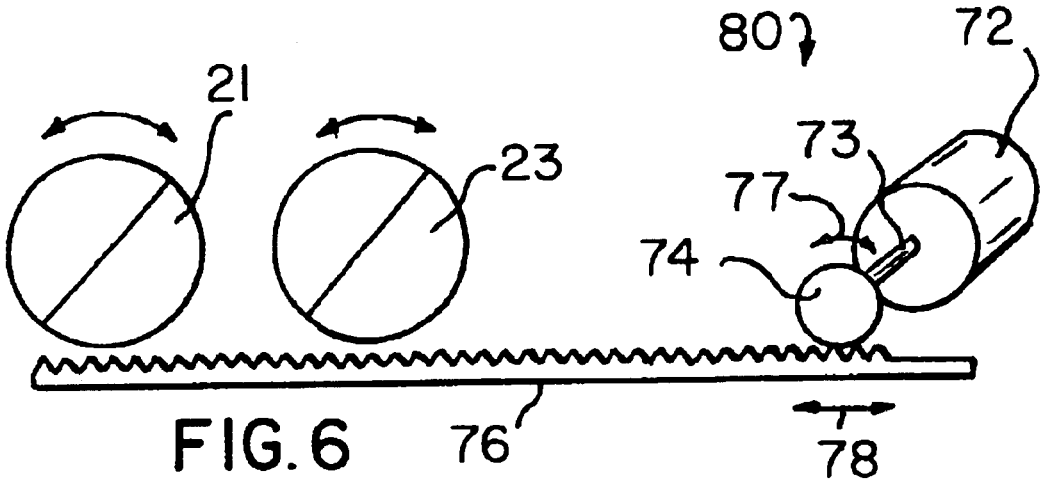
FIG. 6 is schematic illustration of an elevation drive mechanism portion of the antenna array of FIG. 1.

Attention is now drawn to FIG. 6, which is a schematic illustration of an elevation drive mechanism 80 of the antenna array of FIG. 1. The elevation drive mechanism 80 includes drive motor 72 previously mentioned in connection with FIG. 4. The drive motor 72 includes an output shaft 73 and a pinion gear 74 mounted thereon. The pinion gear 74 meshes with a rack 76 such that back and forth rotation of the pinion gear 74 in the direction of direction arrow 77 results in back and forth translation of the rack 76 in the direction of direction arrow 78. Ring gears (unshown) are mounted to the antenna elements, such as antenna elements 21 and 23 depicted in FIG. 6. In this way, back and forth translation of the rack gear 76 in the direction of direction arrow 78 causes back and forth rotation of the antenna elements, such as antenna elements 21 and 23, about their longitudinal axes. In this way, the drive motor 72 is able to effect movement of the antenna elements to change their elevation orientation. It should be understood that while only two antenna elements are depicted in FIG. 6, the other antenna elements are likewise manipulated in the same way.

Figure 7A:
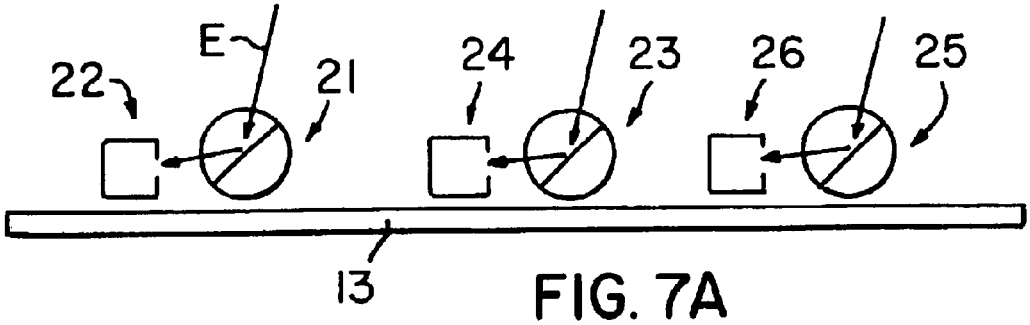
FIG. 7A is a schematic illustration of an antenna element/feed coupling arrangement portion of the antenna array of FIG. 1 according to a first preferred form.

FIG. 7A is a schematic illustration of an antenna element/feed coupling arrangement portion of the antenna array of FIG. 1 according to a first preferred form. In this configuration, the antenna elements, such as antenna elements 21, 23, and 25, are associated with feed sources 22, 24, and 26 which are positioned laterally to the side of the antenna elements. In this regard both the antenna elements and the feed sources are positioned atop the platen 13.

Figure 7B:
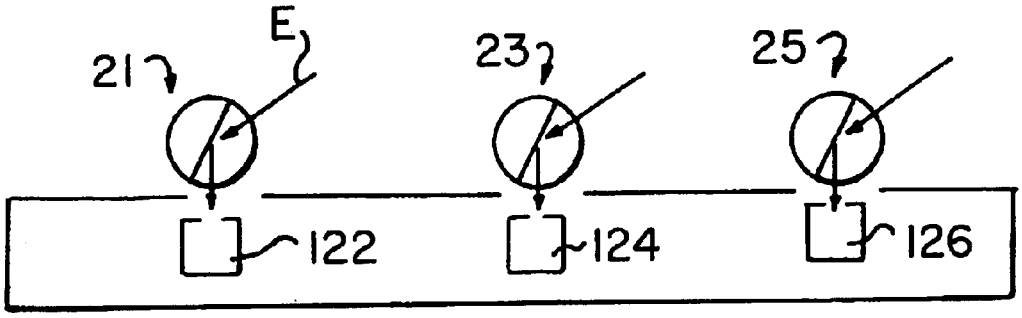
FIG. 7B is a schematic illustration of an antenna element/feed coupling arrangement portion of the antenna array of FIG. 1 according to an alternative form.

FIG. 7B is a schematic illustration of an antenna element/feed coupling arrangement portion of the antenna array of FIG. 1 according to an alternative form. In this configuration, the antenna elements 21, 23, and 25 are associated with feed sources 122, 124, and 126 which are positioned beneath the antenna elements. This arrangement has the advantages of providing a short transmission line path, no or minimal blockage, and a large projected aperture at low elevation angles.

Figure 8:
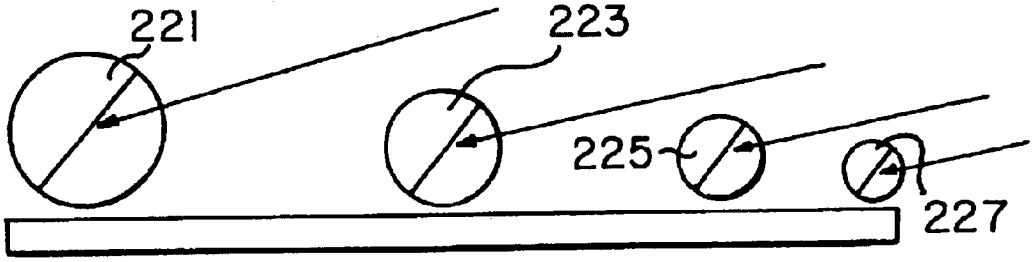
FIG. 8 is a schematic illustration of an antenna element configuration portion of the antenna array of FIG. 1 according to an alternative preferred form in which the antenna elements are of differing sizes.

FIG. 8 is a schematic illustration of an antenna element configuration portion of the antenna array of FIG. 1 according to an alternative preferred form in which the antenna elements are of differing sizes. As shown, first antenna element 221 is larger than the second antenna element 223, which in turn is larger than the third antenna element 225, and which in turn is larger than the fourth antenna element 227. One advantage of this arrangement is that the antenna elements can be spaced somewhat closer together while maintaining good effectiveness at low receive angles.

Figure 9A:
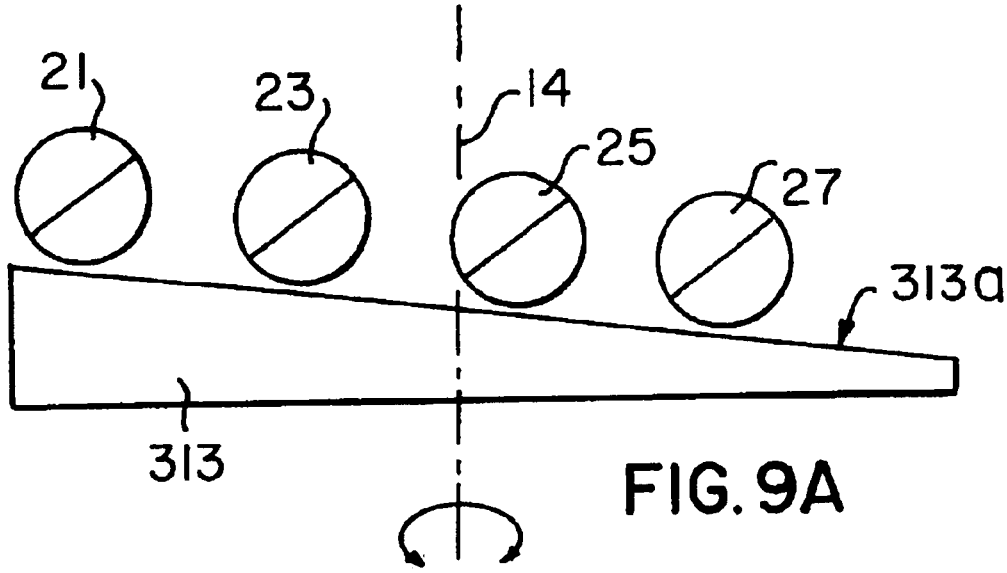
FIG. 9A is a schematic illustration of an antenna element configuration portion of the antenna array of FIG. 1 according to an alternative preferred form in which the antenna elements are of constant size, but the platen to which they are mounted is inclined at an acute angle with respect to the azimuth axis.

FIG. 9A is a schematic illustration of an antenna element configuration portion of the antenna array of FIG. 1 according to an alternative preferred form in which the antenna elements are of constant size, but the platen to which they are mounted is inclined at an acute angle with respect to the azimuth axis. As shown, the platen 313 is generally wedge-shaped in this way, the upper surface 313*a* of the platen is tilted relative to the azimuth axis 14. This helps the antenna system operate more effectively at low receive angles, but at the expense of a somewhat larger profile.

Figure 9B:
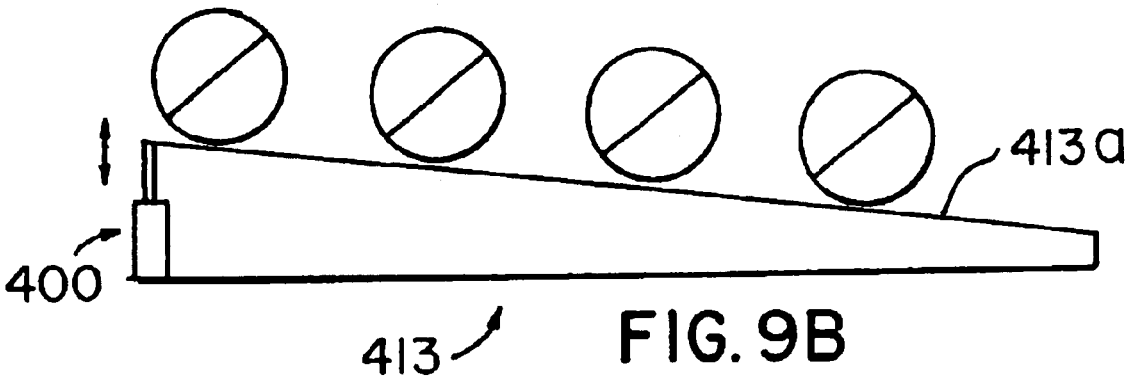
FIG. 9B is a schematic illustration of an antenna element configuration portion of the antenna array of FIG. 1 according to an alternative preferred form in which the antenna elements are of constant size, but the platen to which they are mounted is movable between being perpendicular to the azimuth axis and inclined at an acute angle with respect to the azimuth axis.

FIG. 9B is a schematic illustration of an antenna element configuration portion of the antenna array of FIG. 1 according to an alternative preferred form in which the antenna elements are of constant size, but the platen to which they are mounted is movable between being perpendicular to the azimuth axis and inclined at an acute angle with respect to the azimuth axis. Here the platen 413 has an upper surface 413*a* which is hinged so the platen upper surface (and the antenna elements) can be pivoted upwardly to help work at low receive angles and pivoted downwardly to lower the profile when the low receive angle is not needed. To accomplish this, an actuator 400 is provided. The actuator can take many forms, such as a solenoid, as a small air bladder, as a screw drive, etc.

Regarding the number and size of the antenna elements, such as antenna, 21, if a smaller diameter is used, this leads to more cylinders to obtain the same effective total area. This leads to increases in cost due to the larger number of phase shifters. It is contemplated that somewhere between about two and twelve antenna elements are preferred, and it is more preferred that there be about 4 to 8 antenna elements. One could use fewer, larger cylinders, but at the expense of increasing antenna height (profile).

Ideally, the antenna array would be less than about three feet in diameter. For aesthetic reasons, is preferred that the antenna array is as small as possible. However, to obtain the relatively weak signals from a remote source, larger array sizes provide a stronger reception. The balance between these two competing design considerations provides for a preferred antenna array size of between about one foot and three feet, with the most preferred size being about 18 to 30 inches. Moreover, ideally the array is arranged in a circular fashion to minimize the footprint while maximizing collection effectiveness. However, non-circular arrays could be employed. Also, while the arrays depicted in the figures are planar in that all of the antenna elements lie in a common plane (or very nearly so), it is possible to make the upper surface of the platen curved and to place the antenna elements along this curved surface such that a curved array is provided. This is very effective for low angle reception, but at the cost of some increased profile.

While the invention has been disclosed in preferred forms, those skilled in the art will recognize that many modifications, additions, deletions, and changes can be made therein without departing from the spirit and scope of the invention as set forth in the following claims. For example, while mechanical phase shifters are specifically disclosed herein, those skilled in the art will recognize that electronic phase shifters could be employed, although at slightly higher cost.

What is claimed is:

1. An antenna system for a moving vehicle comprising:

a platen mounted atop the vehicle for rotation about a rotation axis;

an azimuth drive for rotating the platen;

an array of antenna elements each pivotally mounted to the platen in substantially parallel relation to the platen;

a feed source associated with each antenna element to collect energy from the element;

an altitude drive for pivoting the antenna elements relative to the platen while maintaining the antenna elements in the substantially parallel relation to the platen to allow the antenna elements to be oriented at various elevation angles, wherein each antenna element is individually pivotable; and a pointing controller for monitoring the signal received by the array of antenna elements and controlling the azimuth drive and the altitude drive to maximize the strength of the signal so received or to maintain the strength of the signal above a threshold level.

2. An antenna system as claimed in claim 1 wherein the antenna elements each comprises a lens and a reflector.

3. An antenna system as claimed in claim 1 wherein the antenna elements are pivoted together to aim them at a satellite.

4. An antenna system as claimed in claim 2 wherein the antenna elements are all substantially the same size and lie substantially in one plane.

5. An antenna system as claimed in claim 2 wherein the antenna elements each comprises a dielectric half-cylinder with a reflector extending axially therealong.

6. An antenna system as claimed in claim 1 further comprising phase shifters to phase align signals received at the antenna elements.

7. An antenna system as claimed in claim 6 wherein the phase shifters comprise mechanical trombone phase shifters.

8. An antenna system as claimed in claim 6 wherein the phase shifters comprise electronic phase shifters.

9. An antenna system as claimed in claim 1 wherein the sizes of the antenna elements are graduated.

10. An antenna system as claimed in claim 1 wherein the antenna elements are inclined at an acute angle relative to the rotation axis.

11. An antenna system as claimed in claim 1 wherein the antenna elements are spaced from one another to allow energy to be received by each antenna element without any one of the antenna elements blocking the energy from any other of the antenna elements over a wide range of incident angles.

12. An antenna system as claimed in claim 1 further comprising a base mounted to the vehicle between the platen and the vehicle, and wherein the base has a major dimension of about 30 inches or less.

13. An antenna system as claimed in claim 1 wherein the antenna array system has a low profile in which the antenna system is much wider than it is tall to minimize wind resistance and wind noise.

14. An antenna system as claimed in claim 1 wherein the array of antenna elements is comprised of between 2 and 12 antenna elements.

15. An antenna system as claimed in claim 1 wherein the array of antenna elements is comprised of between 4 and 8 antenna elements.

16. An antenna system as claimed in claim 1 wherein the feed sources comprise slotted waveguides.

17. An antenna system as claimed in claim 16 wherein each slotted waveguide is positioned below its associated antenna element.

18. An antenna system as claimed in claim 16 wherein each slotted waveguide is positioned to the side of its associated antenna element.

19. An antenna system as claimed in claim 1 further comprising a combiner for combining the energy from the feed sources and a single channel rotary joint for coupling the combiner with an external device.

20. An antenna system as claimed in claim 1 wherein at least an upper portion of the platen is oriented at an acute angle relative to the rotation axis.

21. An antenna system to be mounted to a vehicle for receiving signals transmitted by sources that include Direct Broadcast Satellites, the antenna system comprising:

an array of antenna elements;

an azimuth drive for rotating the array about an azimuth axis;

an altitude drive for pivoting the antenna elements individually about their axes to change the elevation at which the antenna elements are pointing, wherein each antenna element is individually pivotable; and wherein over a range of vehicle orientations the array of antenna elements can be pointed at a satellite by operation of the azimuth drive and/or the altitude drive.

22. An antenna system as claimed in claim 21 wherein the azimuth drive comprises a platen to be mounted to the vehicle for rotation, the array is mounted to the platen, and the azimuth drive further comprises a drive motor for rotating the platen.

23. An antenna system as claimed in claim 21 wherein the altitude drive comprises a single drive motor for pivoting all of the antenna elements together.

24. An antenna system as claimed in claim 21 further comprising a pointing controller for monitoring the signal received by the array of antenna elements and controlling the azimuth drive and the altitude drive to maximize or maintain the strength of the signal so received.

25. An antenna system as claimed in claim 21 further comprising mechanical phase shifters associated with the individual antenna elements.

26. An antenna system as claimed in claim 25 wherein the mechanical phase shifters are operated by the same drive motor that also drives the altitude drive.

27. An antenna system as claimed in claim 21 wherein the antenna elements comprise elongate half-cylinder lenses and reflectors extending therealong.

28. A scanning array antenna for mounting to a vehicle, comprising:

a base to be mounted to the vehicle;

a turntable rotatably mounted to the base for rotation about an azimuth axis;

an azimuth drive for rotating the turntable about the azimuth axis;

an array of antenna elements, each pivotally mounted to the turntable in substantially parallel relation thereto and for pivotal movement about an elevation axis;

an elevation drive for pivoting each antenna element relative to the turntable and about its elevation axis, while maintaining the antenna elements in substantially parallel relation to the turntable, wherein each antenna element is individually pivotable;

feed sources associated with the antenna elements; and a combiner for combining signals collected from the feed sources.

29. A scanning array antenna as claimed in claim 28 wherein the turntable is flat and round.

30. A scanning array antenna as claimed in claim 29 wherein the turntable is perpendicular to the azimuth axis.

31. A scanning array antenna as claimed in claim 29 wherein at least an upper portion of the turntable is oriented at an acute angle relative to the azimuth axis.

32. A scanning array antenna as claimed in claim 29 wherein the turntable has a generally wedge-shaped cross-section.

33. A scanning array antenna as claimed in claim 29 wherein the turntable is pivotable between a first orientation which is perpendicular to the azimuth axis and a second orientation which is at an acute angle relative to the azimuth axis.

34. A scanning array antenna as claimed in claim 28 further comprising mechanical phase shifters.

35. A scanning array antenna as claimed in claim 34 further comprising a controller for monitoring signals received by the antenna array and for controlling the elevation drive and the azimuth drive to maximize the signal so received, the controller also being operative for controlling the operation of the mechanical phase shifters.

36. A scanning array antenna as claimed in claim 35 wherein the elevation drive comprises a single motor which is also used to manipulate the phase shifters, wherein the controller is operative for controlling the elevation drive motor.

37. A scanning array antenna as claimed in claim 28 wherein the array of antenna elements comprises several individual antenna elements.

38. A scanning array antenna as claimed in claim 37 wherein several individual antenna elements form a circular array.

39. A scanning array antenna as claimed in claim 38 wherein the several individual antenna elements are generally cylindrical and are parallel to and spaced apart from one another.

* * * * *